US006220310B1

(12) United States Patent
Emmer

(10) Patent No.: US 6,220,310 B1
(45) Date of Patent: Apr. 24, 2001

(54) METHOD FOR FILLING CONTAINERS AND INSTALLATION THEREFOR

(75) Inventor: Gérard Emmer, Le Harve Cedex (FR)

(73) Assignee: Sidel, Le Havre Cedex (FR)

( * ) Notice: Subject to any disclaimer, the term of this patent is extended or adjusted under 35 U.S.C. 154(b) by 0 days.

(21) Appl. No.: 09/462,745

(22) PCT Filed: Jul. 20, 1998

(86) PCT No.: PCT/FR98/01577

§ 371 Date: Jan. 13, 2000

§ 102(e) Date: Jan. 13, 2000

(87) PCT Pub. No.: WO99/05061

PCT Pub. Date: Feb. 4, 1999

(30) Foreign Application Priority Data

Jul. 22, 1997 (FR) ..... 97 09546

(51) Int. Cl.[7] ..... B67C 3/12; B67C 3/10; B67C 3/24

(52) U.S. Cl. ..... 141/51; 141/6; 141/7; 141/11; 141/39; 141/62; 141/82

(58) Field of Search ..... 141/5–7, 39, 40, 141/11, 47, 48, 51, 62, 82

(56) References Cited

U.S. PATENT DOCUMENTS

| | | | | |
|---|---|---|---|---|
| 3,998,030 | | 12/1976 | Straub | 53/37 |
| 5,031,673 | | 7/1991 | Cluesserath | 141/6 |
| 5,163,487 | * | 11/1992 | Clusserath | 141/48 |
| 5,240,048 | * | 8/1993 | Diehl | 141/39 |
| 5,320,144 | * | 6/1994 | Ahlers | 141/11 |
| 5,398,734 | * | 3/1995 | Hartel | 141/82 |

FOREIGN PATENT DOCUMENTS

| | | |
|---|---|---|
| 42 39 954 | 6/1994 | (DE) . |
| 0 465 976 | 1/1992 | (EP) . |
| 2 218 078 | 11/1989 | (GB) . |
| 2 218 079 | 11/1989 | (GB) . |

* cited by examiner

*Primary Examiner*—J. Casimer Jacyna
(74) *Attorney, Agent, or Firm*—Sughrue, Mion, Zinn, Macpeak & Seas, PLLC

(57) ABSTRACT

A method for filling a plastic container (8) while it is still hot and deformable without damaging it, when the filling comprises a phase (17; 13) during which a noticeable difference in pressure between the container inside and the environment external to the filling installation occurs, at least during part of said phase, consisting in placing the container in a sealed chamber (9) isolating it from the external environment and modifying (18; 12) the pressure inside the chamber to reduce, even cancel, the difference in pressure between the container inside and outside. The invention is applicable to the filling of plastic containers, with aerated beverages and/or their filling after a vacuumizing phase of their internal volume, immediately after they have been made by blowing.

24 Claims, 5 Drawing Sheets

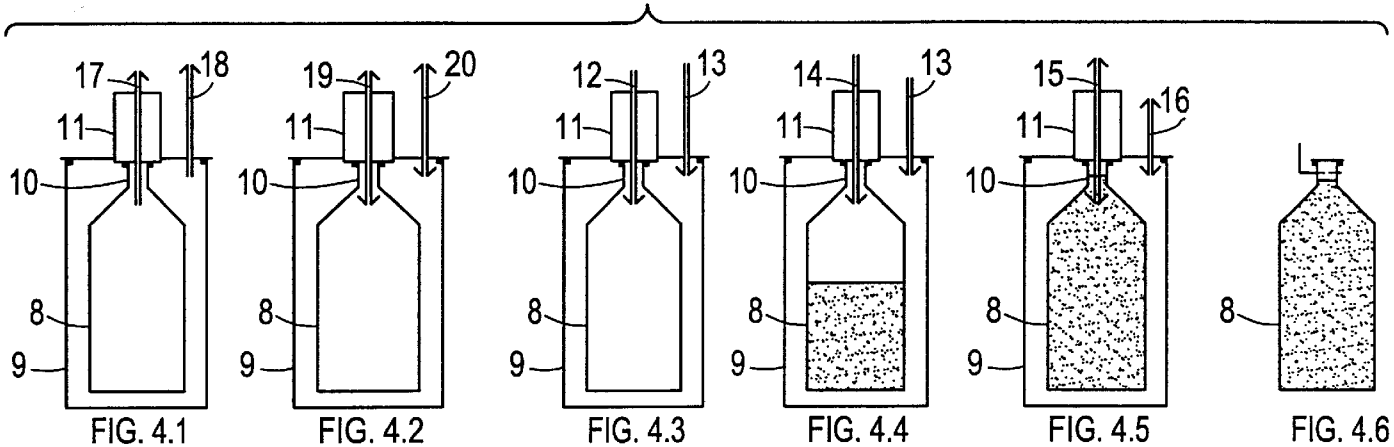
FIG. 4
FIG. 4.1
FIG. 4.2
FIG. 4.3
FIG. 4.4
FIG. 4.5
FIG. 4.6
8
9
10
11
12
13
14
15
16
17
18
19
20
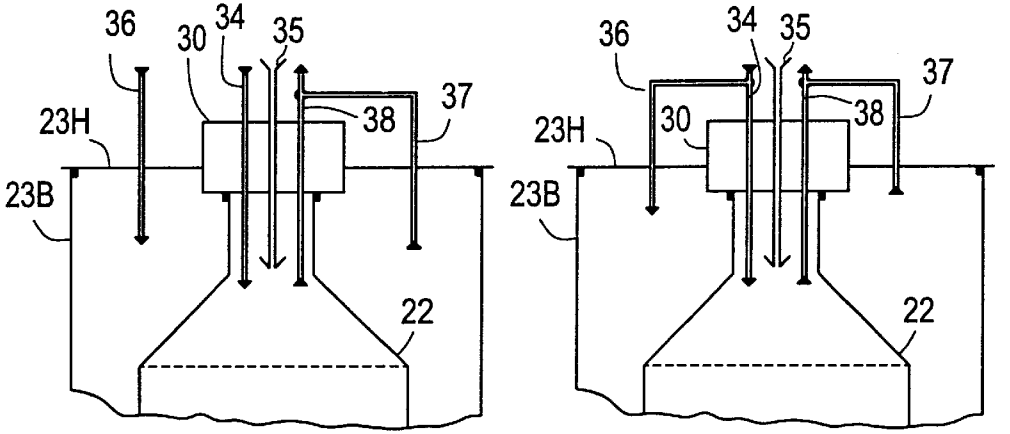
FIG. 8
FIG. 9
FIG. 10
22
23B
23H
30
34
35
36
37
38
39
40
41

METHOD FOR FILLING CONTAINERS AND INSTALLATION THEREFOR

BACKGROUND OF THE INVENTION

The invention concerns improvements made at the time of filling containers of plastic material, when such operation includes at least one stage during which a significant difference in pressure occurs between the interior of the container and the internal environment in the filling installation, and when the operation is done when the containers are hot and have areas that are more or less malleable. This is the case when the filling phase of the container with any product is preceded by placing them under depression (more or less significant vacuum) from the interior of the container, particularly while being filled with beer, or during overpressure when filling with a gaseous liquid, and when the containers are immediately filled after manufacture by blow molding or extrusion, blowing of a blank. It concerns a procedure and installation for its embodiment.

The filling of a container with any product may sometimes be preceded by placing the interior of the container under vacuum or pronounced depression, for example to replace the air found in it by another medium, to avoid spoiling the product which will be finally packaged in the container. For example, this is the case in the filling of oxide-sensitive products such as beer, certain fruit juices and others: any trace of the oxidizing product must be removed, and in this case it must be rendered inert, for example with nitrogen.

The filling of a container, such as a bottle, with gaseous liquid classically consists of a phase of creating overpressure in the interior of the bottle with a gas, typically carbon dioxide, followed by a phase of filling with liquid, and a phase of depressurization to remove excess gas, while maintaining a certain gas pressure inside.

The pressure difference causes problems in plastic containers, when filling is attempted a few seconds after the containers came out of the blowing mold and are still hot, as is the case in the so-called in-line filling installations.

With these containers, it is not possible to put them under depression before filling, without causing deformation by collapse or crushing of the containers.

With the same type of containers, filling with gaseous liquids creates the following problem: the overpressure phase of the containers before filling makes them burst or causes irreversible deformation.

The deformations or bursting affect the body of the containers, but one can see deformations affecting more particularly the bottom of the containers (a phenomenon called "stress cracking" in professional language).

These phenomena are due to the fact that the plastic container is obtained by blowing of a blank (preform, parison, intermediate container), before bringing it to its blow temperature, therefore softened by heat. When the container comes out of the blowing mold, it still has more or less hot zones, which are therefore more or less malleable. In general, these are the zones that are extruded the least during blowing, and which become cold more slowly for various reasons; and the bottom is one of the zones which are the least extruded. However, if, during the time the pressure difference is present, the temperature exceeds the softening temperature even more, a deformation may occur because of the mechanical force exercised on these zones by internal pressure (overpressure or depression)

It also happens, although more rarely, that bursting or deformations occur when filling is done without creating depression or prior overpressure with a gas, and the pressure at which the liquid is introduced or, more generally, the pressure of the filling product is high.

Indeed, plastic containers and therefore their blanks are sized to withstand internal pressure values (overpressure or depression) necessary for the filling or the preservation of the products after closing, when the material is stabilized and therefore cooled.

This is why, until now, all filling attempts under the aforementioned conditions, with plastic containers which still have zones at a temperature higher than the softening temperature, and sized to withhold the same conditions when the material is stabilized, have failed, and in-line filling was not applied at industrial scale.

A possible solution has been to oversize the containers in order to compensate their formation by surplus material. This solution, however, is not realistic for several reasons, among which are: on the one hand, it is in contradiction with the current trend to make the containers longer, for reasons of cost of materials; on the other hand, the containers contained are rather unaesthetic; in addition, paradoxically, the surplus of material makes the containers fragile when stabilized; finally, the surplus material necessary for filling, becomes useless when the containers are cooled.

BRIEF SUMMARY OF THE INVENTION

The purpose of the invention is to remedy these shortcomings and allow filling containers sized to withhold filling pressures when cold, but deformable at least during part of the filling.

According to the invention, a procedure to prevent the irreversible deformation or deterioration of a plastic container with at least one zone in which the temperature exceeds the softening temperature of the material, during a filling operation including a phase in which a notable pressure difference exists between the inside of the container and the external environment in the filling installation, is characterized by the fact that, at least during part of such phase, as long as it is not thermally stabilized and is still deformable, the container is placed in an airtight enclosure which isolates it from the external environment, the pressure inside the enclosure is modified by comparison to the external environment so as to reduce or even cancel the pressure difference between the interior and the exterior of the container.

Thus, by reducing or even canceling the pressure difference between the interior and the exterior of the container, as long as the material is not thermally stabilized, the risk of bursting or deformation is eliminated, and filling becomes possible while the container still has malleable zones.

According to another characteristic when the pressure difference between the interior of the container and the external environment is obtained by producing vacuum inside the container, the pressure inside the enclosure is modified, reducing it in order to bring it close or even equal to the pressure inside the container.

Preferably, the reduction of the pressure inside the enclosure and inside the container are done simultaneously.

According to another characteristic, the filling product is a gaseous liquid, and the pressure modification is done by injecting a fluid under overpressure into the enclosure, isolating the container from the external environment. In this case, the arrival of the filling liquid favors the cooling of the container, which then stabilizes quickly.

According to another characteristic, the fluid is a gas in an embodiment, when the liquid is gaseous, the modification of the pressure is done with the help of the gas used in gasification (especially carbon dioxide).

In this case, it is easy to achieve pressure balance between the interior and the exterior of the container, by simultaneously modifying the pressure in the container and in the enclosure, in which case the problems of bursting or deformation are totally eliminated.

BRIEF DESCRIPTION OF THE DRAWINGS

Other characteristics and advantages of the invention appear when reading the description below, made in connection with the enclosed figures, in which:

FIG. 4 illustrates schematically the principle of the invention applied to the previous depression of a container, followed by filling with a gaseous liquid;

FIGS. 8 and 9 are schematic views of variations of part of the installation for the embodiment of the invention;

FIG. 10 illustrates an advantageous embodiment of part of FIGS. of 8 and 9.

DETAILED DESCRIPTION OF THE INVENTION

Figure 1:
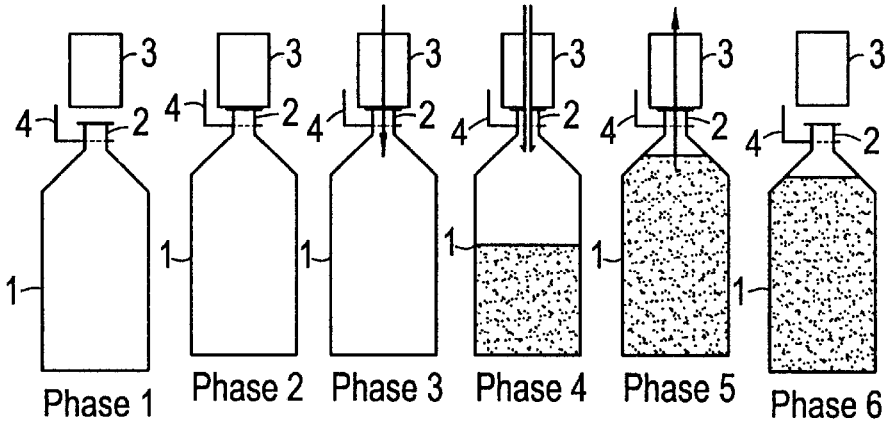
FIG. 1 illustrates schematically the various phases of filling with gasification, with resistant containers.

By referring to FIG. 1, a known cycle of filling of a container with gaseous liquid, such as a carbonated liquid, typically includes the following phases.

1) "Phase 1", during which the container, here a bottle 1, is introduced into the filling machine and is positioned so that its next two is at the level of the filling head 3. When bottle 1 is made of plastic, during the various phases, it is maintained under its next two, with the help of appropriate means, such as clamp 4, to avoid that, in subsequent phases, bottle 1 collapses under the pressure exercised by head 3.
2) A "phase 2", in which bottle 1, and more precisely its neck 2, is centered by comparison to the filling head the latter is affixed against the neck to ensure air tightness.
3) A "phase 3" of placing the interior of bottle 1 over pressure with the help of an appropriate gas, typically carbon dioxide or a gas found in natural state as a liquid. This phase of putting under internal pressure is carried out by injecting the gas through the conduit(s) going into the filling head 3. It is indicated schematically by arrow 5 in the figures;
4) A "phase 4" of filling through the filling heads 3 (arrow 6 in the figure);
5) A "phase 5" of evacuation of the excess gas in the container (arrow 7) during this phase, the excess gas may be turned towards the tank from which it was injected in phase 3;
6) A "phase 6" of releasing the filling head 3 and evacuation of bottle 1, full, still held in place by clamp 4 under its neck 2.

Generally it is in phase 3 (putting under pressure) and/or phase 4 (filling), that the bursting or deformation problems mentioned in the preamble occur.

Of course, during filling without prior injection of gas, phases 3 and 5 do not exist. It is during the filling phase (phase 4) that the problems can occur, especially if the pressure and/or the filling rate are (is) too high.

Figure 2:
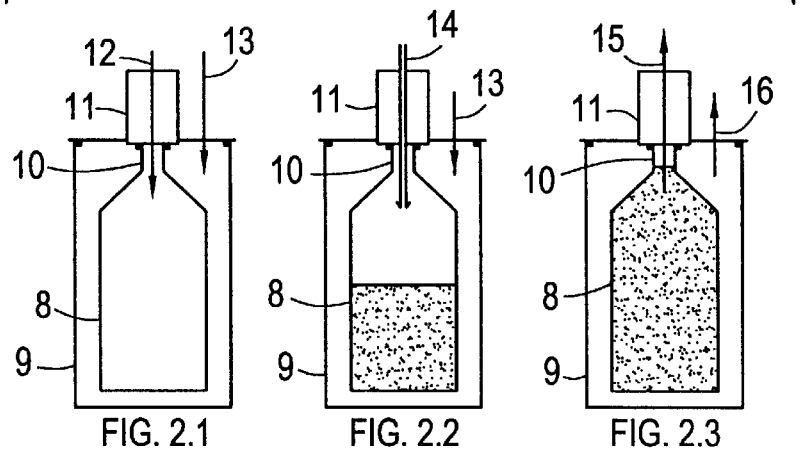
FIG. 2 illustrates schematically the principle of the invention applied to filling with a gaseous liquid.

FIG. 2 illustrates the principle of the procedure of the invention applied to filling plastic containers, such as bottles, with gaseous liquids, such as carbonated drinks.

The procedure may be summarized in three phases, illustrated by diagrams 2-1, 2-2 and 2-3.

In FIG. 2-1:

After container 8, here a bottle, was placed in an air-tight enclosure 9, and its neck 10 was put in air-tight communication with a filling head 11, gas is injected (arrow 12) inside container 8 through a conduit going into the head 11, and a fluid is injected (arrow 13) into the air-tight enclosure through a conduit, in order to exert counter pressure outside the container.

Preferably, the fluid used to exert counter pressure is a gas. A liquid could also be used, but this would significantly complicate the embodiment of the invention: indeed, unless a non-wet liquid is used, the exterior of the containers would have to be dried after filling.

The moment the fluid is injected into the enclosure 9, as compared to the moment the gas is injected into container 8, as well as the relative values of the pressures inside and outside the container are irrelevant: the essential point is that the difference in pressure must be at all times such as to avoid the bursting or deformation of the container.

However, preferably, in order to facilitate the embodiment of the procedure, the injection of the counter pressure fluid and gas take place simultaneously.

As an alternative, it is possible to slightly delay the moment in which the increase in pressure begins in container 8 by comparison to the time the increase in pressure begins in enclosure 9, starting first to increase pressure in the container and then starting in enclosure 9, before the pressure in the container becomes too high.

Then comes the filling phase, through a conduit 14, in FIG. 2.2, during which the counter pressure is preferably maintained. Indeed, it is likely that, in this stage, the container is not yet stabilized.

The next stage (FIG. 2.3) is degassing of the interior of container 8 (arrow 15 in this figure) and a phase of relaxation of the counterpressure (arrow 16 in the same figure) before the container comes out of the machine to be closed, or alternatively, closed before coming out, if the machine is a filling-closing machine.

In one embodiment, the counterpressure is released right before the internal pressure is established, i.e., before filling or during filling. However, the process is more random and difficult to control because if the container is not sufficiently stabilized, there can still be deformations and/or bursting.

In another embodiment, the release of the counterpressure starts after degassing begins, i.e., when it is certain that the constrains owed to the pressure inside the container have totally disappeared. This solution offers a maximum of safety, but slows down significantly the time of the cycle.

In an embodiment, the entire installation is under overpressure, to exert counterpressure outside the containers. However, this solution is hard to manage because it is necessary to provide means, such as traps, to allow the entry and exit of the containers without significantly reducing overpressure inside the installation.

This is why, preferably, as illustrated in FIGS. 3 through 7, each container introduced in the filling machine is closed in an enclosure which isolates it from the rest of the environment of the machine. When this enclose is closed, the gasification, counterpressure, filling, degassing and release of the counterpressure take place.

Thus, if the containers are introduced one by one, one group after the other, so as they go through the various phases in a staggered manner, each container is closed in a different enclosure than the preceding one and the following one in the installation. On the contrary, if the containers are introduced by successive groups, then all the containers in a same group can be introduced simultaneously in the same enclosure, different than the preceding or following group. However, it is still possible to introduce all the containers of a same group simultaneously in different enclosures.

Figure 3:
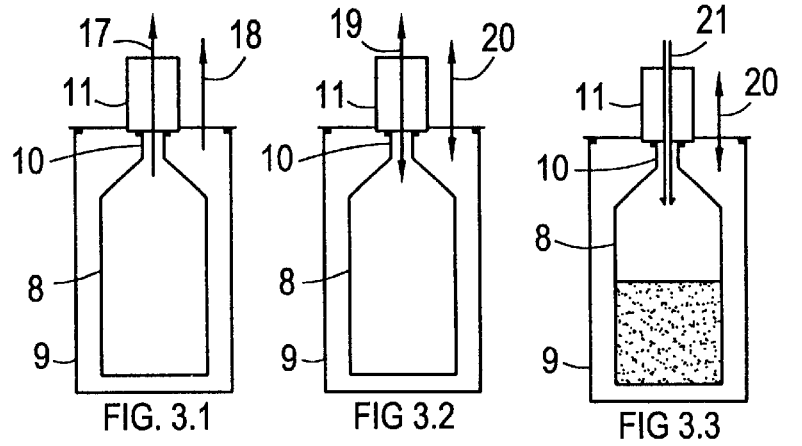
FIG. 3 illustrates schematically the principle of the invention applied to the previous depression of the interior of a container.

FIG. 3 illustrates the way the invention is applied to the prior putting under vacuum of a container 8, thus allowing to obtain, with plastic containers still malleable, what the prior state of the art did not allow.

After container 8 was locked in the air-tight enclosure 9, and its neck 10 was put in communication with the filling head 11, a depression (arrow 17) is created inside the container and is accompanied (arrow 18) by a depression inside the enclosure, to avoid the collapse of container 8.

Depressions in enclosure 9 and container 8 may have the same value, and take place simultaneously. Then, a balance may be obtained between the pressure inside and outside the container.

Alternately, it is possible to slightly stagger the time the depression begins in the container, as compared to the time it begins in the enclosure, preferably by first creating vacuum in enclosure 9. Equally, the final values of the depressions in the enclosure and in the container may not be equal. They must be adapted so that, finally, the container does not undergo any undesired deformation.

After the depression in the container has produced its effect (for example, preparation of an inert gas with nitrogen), an atmospheric pressure may be reestablished inside container 8 and enclosure 9. For this purpose, as illustrated in FIG. 3.2, both the interior of container 8 and the interior of enclosure 9 are brought back to outside (arrows 19 and 20, respectively).

Preferably, in order to avoid any deformation of container 8 in this stage, it can be put back under atmospheric pressure before enclosure 9.

Then (FIG. 3.3), the container is filled (arrow 21). In this stage, it is no longer fundamental to keep it in enclosure 9 because the internal pressure in enclosure 9 is equivalent to the external pressure from the preceding phase (FIG. 3.2), unless the purpose of filling was to gasify the content, which will be explained with reference to FIG. 4.

The container may then be closed, and then removed.

As illustrated in FIG. 4, the invention presents the particular advantage that the same installation can be used to combine the two methods referred to in connection with FIGS. 2 and 3, respectively.

The same elements bear the same references.

After a container 8, here a bottle, was placed in the air-tight enclosure 9 (FIG. 4.1) a depression is created both inside the bottle (arrow 17) and in enclosure (arrow 18).

Then (FIG. 4.2), the interior of the bottle and that of the enclosure are placed under external atmospheric pressure (arrows 19 and 20), then (FIG. 4.3), the interior of the bottle and that of the enclosure can be put under pressure (arrows 12 and 13) before the bottle is filled (arrow 14 in FIG. 4.4).

Then (FIG. 4.5), the pressure inside the enclosure and the bottle can be released (arrows 15 and 16), before the full bottle comes out of the enclosure (FIG. 4.6).

It is therefore conceivable that an installation for the implementation of the procedure according to the invention can be very simple to make: it suffices to have an air-tight enclosure with the appropriate conduits in order to create vacuum in the enclosure and container and/or to create overpressure inside the enclosure and inside the container.

Figure 5:
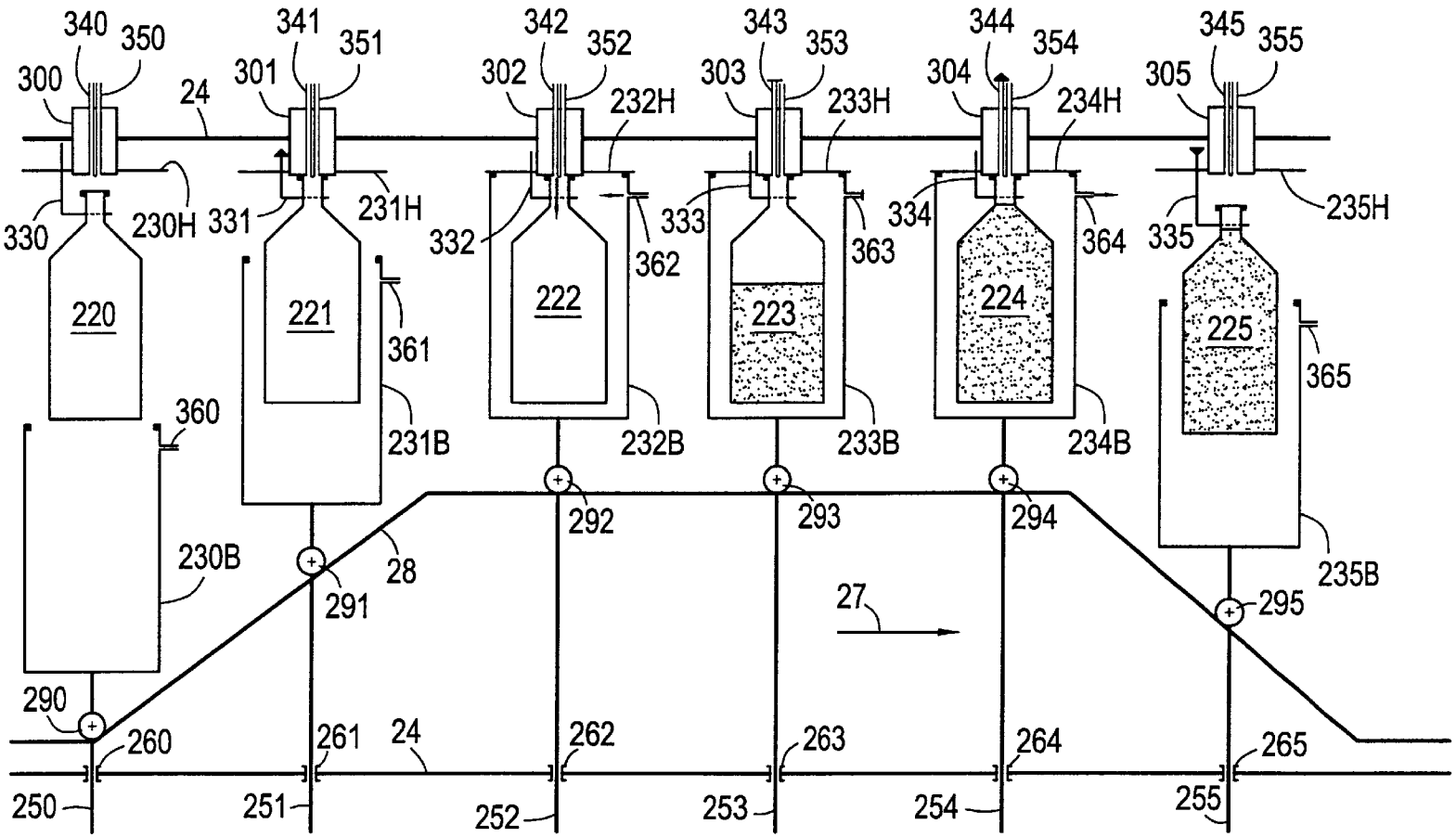
FIGS. 5 and 6 illustrate two possible embodiments of an installation for the utilization of the invention for filling with a gaseous liquid.
Figure 6:
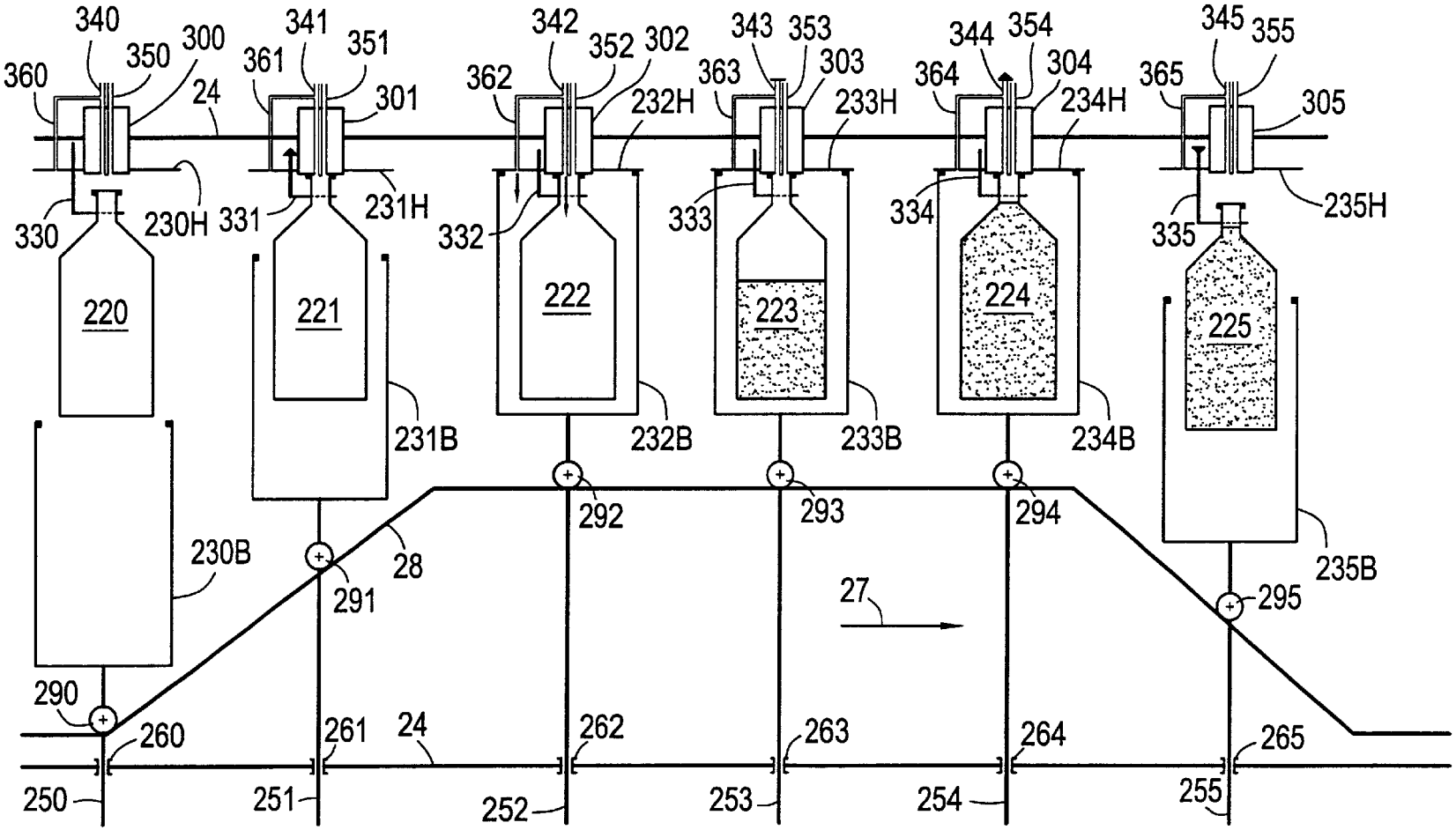

FIGS. 5 and 6 illustrate schematically two possible methods of realization of installations for the embodiment of the procedure under the invention. More precisely, these figures show the parts of the installation used for filling with putting the container under vacuum and/or under internal overpressure.

These figures show in-line filling installations, in which the containers are continuously moved. Of course, the invention can apply to other types of installations.

The difference between FIGS. 5 and 6 is as follows:

- in the method of embodiment in FIG. 5, the overpressure fluid of the enclosure associated to a container is different from that used to create overpressure inside the container. The enclosure can be put under overpressure with compressed air, while the container is put under overpressure with the gas used to gasify the filling produce (for example, carbon dioxide in the case of carbonated drinks);
- in the method of embodiment in FIG. 6, the gas which creates overpressure in the container is also used to put the enclosure under overpressure.

The latter solution has the advantage of creating isopressure between the enclosure and the container. On the contrary, when the enclosure is opened, the quantity of gas remaining in the enclosure when degassing is completed is lost.

Consequently, it is not economical from the viewpoint of gas consumption.

Due to the similarities existing between the two figures, the similar or identical elements have the same references. On the other hand, in order to simplify the understanding of these figures, whenever necessary, symbols were associated to the various conduits, showing the existence or absence of flows of liquid and/or gas (arrows indicating the existence and direction of a flow, or a line barring a conduit to indicate that it is or must be closed up, to prevent the passage of liquid or gas).

The installations in FIGS. 5 and 6 are filling installations in which the containers pass continuously, i.e., each container, while being continuously moved on a determined trajectory, is related to the means to create vacuum and/or to create pressure, on the one hand, and filling means, on the other hand.

FIGS. 5 and 6 show six containers (here, bottles) 220; . . . ; 225, each associated to a different enclosure, and therefore to different means to create vacuum and/or overpressure and filling.

Each enclosure consists of two different parts, respectively a top part 230H; . . . ; 235H forming a lid and a bottom part 230B; . . . ; 235B forming a receptacle to receive the corresponding container. The dimensions of a receptacle 230B; . . . ; 235B are such that, when the lid 230H; . . . ; 235H is in place, the container is held in the enclosure, as explained below.

The top parts 230H; . . . ; 235H, as well as the bottom parts 230B; . . . ; 235B are affixed to the mobile structure 24 of the installation, so that all the top parts 230H; . . . ; 235H follow the same trajectory, staggered over time, on the one hand and all bottom parts 230B; . . . ; 235B follow the same trajectory, also staggered over time.

On the other hand, in the methods of embodiment illustrated in FIGS. 5 and 6, each bottom part 23OB; . . . ; 235B can be removed from the corresponding top part (lid) 230H; . . . ; 235H, especially in the faces in which the containers are put into place or taken out. For this purpose, each bottom part is associated to means such as a guiding rod, respectively 250; . . . ; 255, for example sliding in a landing 260; . . . ; 265 built into the mobile structure 24.

Preferably, as illustrated by these FIGS. 5 and 6, the mobile structure 24 causes a horizontal displacement of the top and bottom parts, respectively, and the means 250; . . . ; 255 260; . . . ; 265, cause a vertical movement of the bottom parts 230B; . . . ; 235B, as compared to the mobile structure when it moves in the direction of the arrow 27, and therefore by comparison to the top parts 230H; . . . ; 235H.

For vertical movement, for example, as illustrated by these FIGS. 5 and 6, there is a fixed cam 28 acting on a guide 290; . . . 295 respectively is provided, associated to each rod 250; . . . 255.

More precisely, the cam 28 is affixed on the frame, not represented, of the installation, so that, when the guide associated to a rod, and therefore, to the corresponding bottom part (receptacle) meets the fixed cam, it follows the profile imposed by the shape of the cam, causing a movement that corresponds to the associated receptacle.

In the example illustrated by FIGS. 5 and 6, a first receptacle 230B is in bottom position. The corresponding container 220 has just been loaded; the guide 290 is below the cam.

The second receptacle 231B, corresponding to the second container 221 is partially raised.

The following three 232B; . . . ; 234B are totally raised and in contact with their corresponding lid 232H; . . . ; 234H; consequently, the enclosures are closed, and the vacuum and/or application or pressure, as well as filling, may take place.

Finally, the last receptacle 235B is descending, the corresponding bottle 225 being filled and liable to be released when the descent is completed.

Alternatively, it could be imagined that the bottom parts could be affixed as compared to the mobile structure 24, with the top parts being mobile in vertical movement as compared to this structure. This would significantly complicate the installation because, as illustrated by FIGS. 5 and 6, the top parts are associated to filling heads 300; . . . ; 305 respectively, with conduits not only for filling, but also for creating vacuum and/or pressure inside the enclosure and/or the corresponding container, and means for anchoring the containers.

Figure 7:
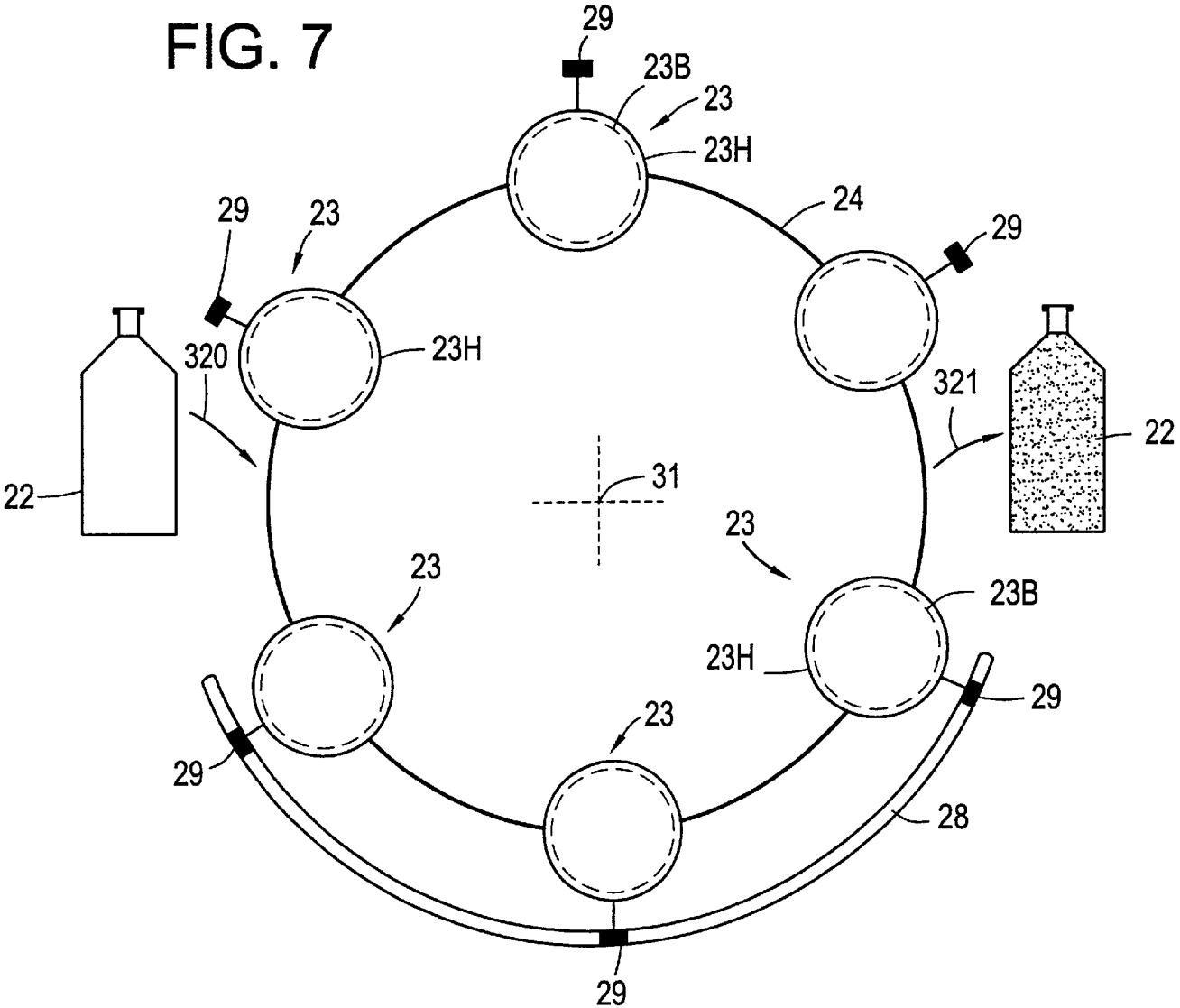
FIG. 7 is a schematic view from above of an installation for embodiment.

Preferably, as illustrated in FIG. 7, the installation can be of a rotating type. In this case, the mobile structure 24 is a carousel turning around a rotation axis 31, the carousel bearing the enclosures more generally referenced under 23, with a top part (lid) 23H and a bottom part (receptacle) 23B, and in this case, the cam 28 which leads the guides 29 is in the shape of a arc.

In a way that is generally known, the containers are introduced one by one into the installation (entrance showed by arrow 320 in FIG. 7); they are grasped at the neck by the respective clamps 330; . . . ; 335 associated to each filling head 300; . . . ; 305 (the clamps are shown in FIGS. 5 and 6). The clamps move vertically in order to place the lip of the containers against the filling head. The rising movement of each clamp takes place, for example, when the container is going up. This is symbolized by an upwards arrow on clamp 331 associated to the container 221.

After the filling and possible degassing of the associated container and enclosure, the corresponding clamp 335 descends again to release the neck of the container 225 from the filling head, before it comes out of the installation (the exit zone is shown by arrow 321 in FIG. 7).

In order to avoid overcharging FIGS. 5 and 6, the only conduits illustrated are those which assure the internal overpressure of the enclosures and containers, and the filling of the latter. Equally, there is no illustration of the connection between these conduits and the sources of liquid and gas, nor the sources themselves, because the specialist will be able to reconstitute these connections from the description.

Each head 300; . . . ; 305 is crossed by a conduit 340; . . . ; 345 to create internal overpressure in the container (gasification) and by a conduit 350; . . . ; 355 for filling.

On the other hand, another conduit 360; . . . ; 365 is provided to create internal overpressure in the enclosure.

In FIG. 5, the conduit 360; . . . ; 365 open in the corresponding bottom part 230B ; . . . ; 235B, alternatively, as illustrated in FIG. 6, they open in the top part 230H; . . . ; 245H.

In FIG. 5, the conduit 140; . . . ; 345 for the gasification of the containers are independent from conduit 360; . . . ; 365 which create internal overpressure in the enclosures. Thus, it is possible to place each enclosure under overpressure with a fluid other than the gas for gasification of the filling product. As an example, it is possible to use compressed air in order to create overpressure inside the enclosure.

In FIG. 6, each conduit 340; . . . ; 345 for the gasification of a container is associated (by a bypass) to the corresponding conduit 360; . . . ; 365 for creating overpressure in the enclosure. Thus, the gas for the gasification of the container can also be used to create overpressure in the enclosure.

Overpressure and filling operations are conducted after the enclosure is closed, as described concerning FIG. 3. In the example in FIGS. 5 and 6, the container 222 and the corresponding enclosure 232H, 232B are about to be placed under overpressure; the container 223 is about to be filled, the pressure in this container and in the enclosure are maintained (as shown by a bar across conduit 363 which creates pressure in the enclosure) container 224 is full, and pressure is released both in the container and in the enclosure; finally, the bottom part 235B of the enclosure associated to the container 225, full, is about to descend to allow the container to exit.

FIG. 8 shows the diagram of principle of a perfected top part 23H, which can be adapted to the method of embodiment in FIG. 5 while also allowing the depression in the container and enclosure.

In addition to the conduits, more generally designated by 34, for the gasification of the container 22 through the filling head 30, 36 for creating overpressure in the enclosure, and 35 for filling through the head 30, there are two conduits, respectively 37 for creating vacuum in the enclosure and 38 for creating vacuum in container 22 through the head 30. These two latter conduits are either connected between them as illustrated in FIG. 8, which allows connecting them to a common vacuum pump (not shown), or are not connected between them, but they are connected to separate pumps.

On the other hand, the conduit 34 for gasification of the content and 36 for creating overpressure in the enclosure are separated, allowing, for example, to place the enclosure under overpressure using compressed air.

In FIG. 9, which is a diagram of principle of a perfected top part 23H adaptable for the method of embodiment in FIG. 6, while also allowing to create depression in the enclosure and in the container 22, one finds the same conduits as in FIG. 8, but the conduits, respectively, 34 for gasification of the content and 36 to create overpressure in the enclosure, are connected between them, allowing to create overpressure in the enclosure with the gasification gas.

A problem presented by the methods of embodiment in FIGS. 5, 6, 8 and 9 is that two conduits 34, 35 or three conduits 34, 35, 36 cross the filling head 30, which somewhat complicates its structure.

This is why, in a method of embodiment illustrated in FIG. 10, the conduits are connected to a valve 39 with mechanical control 40, electric or other type of control.

An intermediary conduit 41 is connected to the head 30 and establishes communication between this valve and the interior of the container 22. By operating the control 40, communication is established between the interior of the container 22 either with the vacuum conduit 38 (when it exists) or with the gasification conduit 34 (when it exists), or with the filling conduit 35.

The invention allows filling containers which are still hot and therefore deformable, without causing them irreversible deformations, because of the limitation of the difference in pressure it allows between the interior and exterior of the containers. In addition, it has been found that the filling liquid contributes to cool the bottom of the containers before external pressure is brought back to the ambient level. Consequently, the bottoms are stabilized when the exterior pressure is released.

Of course, as it arises from the above, the invention is not limited to the methods of embodiment and application which were more particularly considered: on the contrary, it covers all variations.

What is claimed is:

1. Method to prevent the deformation or the irreversible deterioration of a plastic container (8; 22; 220; . . . 225), having at least one zone where the temperature exceeds the temperature needed to soften the material, when a filling operation that has a phase during which a noticeable pressure difference occurs between the internal part of the container and the external environment at the filling installation, characterized, at least, during a part of the mentioned phase, which is not thermally balanced and is still deformable, being the container placed inside a tight chamber (9; 23B, 23H; 230B, 230H; . . . ; 235B, 235H) and isolated from the external environment; the internal pressure of the chamber is modified in relation to the external environment, in order to reduce, or even to cancel, the difference in pressure between the internal and external parts of the container.

2. A method of claim 1, characterized by the difference of pressure between the internal part of the container and the external environment, being obtained by creating a vacuum (17) in the container; the pressure in the internal part of the chamber is modified by reduction (18) in order to be closer, or even reach, the pressure of the internal part of the container.

3. A method of claim 2, characterized by the fact that the reduction of the pressure inside the chamber is started before the reduction inside the container.

4. A method of claim 1, characterized by the filling being carried out with a product, such as a liquid, gasified, and comprising, consequently, a previous phase of overpressure (12) inside the container with the gas serving for the gasification; the modification of the pressure inside the chamber being carried out by means of injecting (13) a fluid under overpressure in the chamber.

5. A method of claim 4, characterized by the fluid which is a gas.

6. A. A method of claim 5, characterized by the fact that the gas injected in the chamber is the same as the gas used for gasification inside the container.

7. A method of claim 5, characterized by the fact that the gas injected in the container is different from the gas injected in the chamber.

8. A method of claim 7, characterized by the fact that the gas is compressed air.

9. A method of claim 4, characterized by the fact that the modification in chamber pressure to be put under overpressure is started after the modification in the container.

10. A method of claim 1, characterized by the fact that modification of the pressure inside the chamber and the modification of the pressure inside the container take place simultaneously.

11. Application of a method of claim 1 for filling a plastic container obtained by heat, then blowing, alternatively extending/blowing, pre-shaping, immediately after blowing and alternatively extending/blowing.

12. Installation for the operation of the method of claim 1, characterized by the fact that it has, at least, one tight chamber (9; 23B; 23H; 230B, 230H; . . . ; 235B, 235H) to receive, at least said deformabled plastic container (8; 22; 220; . . . 225), a means to put the internal part of the container in communication with a filling conduit (14; 21; 35; 350; . . . 355), and a means to prevent irreversible deformation or deterioration of said plastic container while the temperature of said plastic container exceeds the temperature needed to soften the material of the container which includes a means to modify the pressure in the internal part of the chamber and in the internal part of the container.

13. Installation of claim 12, characterized by the fact that the means which are to modify the pressure in the internal part of the chamber consist of a conduit (37) that puts the chamber in communication with the means to reduce (18) the pressure in the internal part of the chamber, and the means to modify the pressure in the container consists of a conduit (38) putting the container in communication with the means to reduce (17) the pressure in the internal part of the container.

14. Installation of claim 13, characterized by conduits (37; 38) associated with a chamber are connected between themselves, and a single medium, such as a vacuum pump, is used to reduce the pressure in the chamber and in the container.

15. Installation of claim 14, characterized by conduits (37; 38) which together with a chamber are connected to separate media, such as a vacuum pump, used to reduce the pressure in the chamber and in the container.

16. Installation of claim 12, characterized by the fact that the means to modify the pressure in a chamber consist of a conduit (36, 360, . . . ; 365), putting the chamber in communication with the means to increase (13) the internal pressure and the means to modify the pressure in the container consist of a conduit (34, 340; . . . , 345) putting the container in communication with the means to increase (12) the internal pressure.

17. Installation of claim 16, characterized by the fact that the conduits (36; 360; . . . ; 365; 34; 340; . . . ; 345) connected to a chamber are connected between themselves and to a single source of fluid, in order to increase the pressure in the chamber and in the container.

18. Installation of claim 17, characterized by the fact that once the filling product is gasified, the only source of fluid is the source of production of the gas of gasification.

19. Installation of claim 16, characterized by the fact that the conduits (36; 360; . . . ; 365; 34; 340; . . . ; 345) connected to the same chamber are connected to different sources of fluid to increase the pressure in the chamber and in the container.

20. Installation of claim 12, characterized by the fact that each chamber comprises two separable parts, a high part (23H; 230H; . . . ; 235H) forming a cover connected to the filling head (30; 300; . . . ; 305) and a short part (23B; 230B; . . . ; 235B) forming a receptacle to receive the container (22; 220; . . . ; 225).

21. Installation of claim 20, characterized by the fact that it comprises the means (28; 250; . . . ; 255; 260; . . . 265; 290; . . . ; 295) to get close to or distant from the corresponding receptacle.

22. Installation of claim 21, characterized by the fact that it comprises the means (24) to support the high parts and the short parts, allowing a high part to get close in relation to the corresponding short part and to move the said parts along a determined route (27).

23. Installation of claim 21, characterized by the fact that the support means (24) and the movement of a chamber are a carrousel turning around an axis (31Y, and the means to get the high and short parts close consist of a cam (28), fixed in relation to the installation, the said cam cooperating with at least a trail (290; . . . ; 295) associated with a shaft of support and guidance for one of the parts of the chamber.

24. Installation of claim 23, characterized by the fact that the shaft supports the short part (230B; . . . ; 235B) of the chamber.

* * * * *